US010022844B2

(12) United States Patent
Lukes et al.

(10) Patent No.: US 10,022,844 B2
(45) Date of Patent: Jul. 17, 2018

(54) TORQUE TRANSMISSION DRIVER

(75) Inventors: Richard W. Lukes, Calmar, IA (US); Brian Leuenberger, Fort Atkinson, IA (US)

(73) Assignee: Infastech Intellectual Properties Pte. Ltd., Singapore (SG)

( * ) Notice: Subject to any disclaimer, the term of this patent is extended or adjusted under 35 U.S.C. 154(b) by 1307 days.

(21) Appl. No.: 13/809,122

(22) PCT Filed: Jul. 7, 2011

(86) PCT No.: PCT/US2011/043198

§ 371 (c)(1),
(2), (4) Date: Apr. 23, 2013

(87) PCT Pub. No.: WO2012/006427

PCT Pub. Date: Jan. 12, 2012

(65) Prior Publication Data

US 2013/0205954 A1 Aug. 15, 2013

Related U.S. Application Data

(60) Provisional application No. 61/362,107, filed on Jul. 7, 2010.

(51) Int. Cl.
*B25B 15/00* (2006.01)
*B25B 15/02* (2006.01)
(Continued)

(52) U.S. Cl.
CPC ..... *B25B 15/001* (2013.01); *B25B 15/004* (2013.01); *B25B 15/005* (2013.01);
(Continued)

(58) Field of Classification Search
CPC ..... B25B 13/48; B25B 13/481; B25B 17/00; B25B 23/00; B25B 13/06; B25B 15/001;
(Continued)

(56) References Cited

U.S. PATENT DOCUMENTS 145,411 A 12/1873 Frearson
2,046,837 A 7/1936 Phillips
(Continued)

FOREIGN PATENT DOCUMENTS

EP 0677667 10/1995
EP 1010900 6/2000
(Continued)

OTHER PUBLICATIONS

International Search Report for PCT/2011/043198.
(Continued)

*Primary Examiner* — Robert Scruggs
(74) *Attorney, Agent, or Firm* — Kegler, Brown, Hill & Ritter Co., LPA; Lorraine Hernandez; Arland T. Stein

(57) ABSTRACT

A torque transmission driver is disclosed. The torque transmission driver has a main body having a first end portion and a second end portion, where the first end portion is adapted to receive and transmit torque from a torque generation source, and the second end portion is opposite the first end portion and has a key shape adapted to fit a recess in a fastener and has a protruding lead end having a taper between 10 and 30 and different in shape than the key shape with at least a portion of the protruding lead end substantially coextensive with the major dimension of the key shape. A torque transmission driver adapted to drive a small fasteners is also disclosed where the key shape is adapted to fit the recess of the small fastener.

16 Claims, 9 Drawing Sheets

(51) Int. Cl.
*B25B 23/12* (2006.01)
*B25B 23/08* (2006.01)

(52) U.S. Cl.
CPC ..... *B25B 15/008* (2013.01); *B25B 15/02* (2013.01); *B25B 23/08* (2013.01); *B25B 23/12* (2013.01)

(58) Field of Classification Search
CPC ... B25B 15/004; B25B 15/005; B25B 15/008; B25B 15/02; B25B 23/08; B25B 23/12
See application file for complete search history.

(56) References Cited

U.S. PATENT DOCUMENTS 2,046,838 A 7/1936 Phillips
2,046,839 A 7/1936 Phillips et al.
2,046,840 A 7/1936 Phillips et al.
2,285,460 A 6/1942 Purtell
2,397,216 A 3/1946 Stellin
2,969,250 A 1/1961 Kull
3,187,790 A 6/1965 Wing
3,584,667 A 6/1971 Reiland
3,763,725 A 10/1973 Reiland
3,812,757 A 5/1974 Reiland
3,884,282 A 5/1975 Dobrosielski
4,006,660 A 2/1977 Yamamoto et al.
4,128,038 A 12/1978 Urwin
4,269,246 A 5/1981 Larson et al.
4,325,153 A * 4/1982 Finnegan ..... F16B 23/0015 411/403
4,528,874 A 7/1985 Dunn
4,878,406 A 11/1989 Simpson et al.
4,970,922 A 11/1990 Krivec
5,020,954 A * 6/1991 Dreger ..... 411/403
5,025,688 A 6/1991 Davis
5,137,407 A 8/1992 Yamamoto
5,207,132 A 5/1993 Goss et al.
5,224,402 A 7/1993 Pettersson
5,237,893 A 8/1993 Ryder et al.
5,279,190 A 1/1994 Goss et al.
5,291,811 A 3/1994 Goss
5,353,667 A 10/1994 Wilner
5,367,926 A 11/1994 Mikic et al.
5,435,680 A * 7/1995 Schuster ..... B25B 13/065 411/403
5,461,952 A 10/1995 Goss
5,513,933 A 5/1996 Rom
6,016,727 A 1/2000 Morgan
6,158,310 A 12/2000 Goss et al.
6,199,455 B1 * 3/2001 Wagner ..... F16B 23/0007 81/121.1
6,253,649 B1 * 7/2001 Shinjo ..... F16B 23/0023 411/404
6,367,358 B1 4/2002 Stacy
6,378,406 B1 4/2002 Totsu
6,393,953 B1 5/2002 Totsu
6,477,923 B2 11/2002 Amis
6,584,876 B2 7/2003 Totsu
6,601,482 B2 8/2003 Hughes et al.
6,685,412 B2 2/2004 Altarac et al.
6,857,340 B2 2/2005 Wagner
6,868,572 B1 3/2005 Newton
6,886,431 B1 5/2005 Petrsorich
6,886,433 B2 5/2005 Totsu
7,165,482 B2 1/2007 Shapoval
7,188,554 B2 3/2007 Baynham
7,225,710 B2 6/2007 Pacheco, Jr.
7,311,026 B2 12/2007 Melton
7,325,470 B2 2/2008 Kay et al.
7,690,282 B2 4/2010 Griffiths
7,708,767 B2 5/2010 Contiliano et al.
7,793,573 B2 9/2010 Gao
2001/0025552 A1 10/2001 Wagner
2005/0166724 A1 8/2005 Castaneda
2007/0245863 A1 10/2007 Edland
2008/0159827 A1 7/2008 Edland
2008/0226423 A1 9/2008 Brooks
2009/0260489 A1 11/2009 Siong
2010/0037737 A1 * 2/2010 Pchola ..... B25B 15/008 81/460
2010/0129176 A1 * 5/2010 Karupaya ..... B21K 1/463 411/404
2010/0192736 A1 8/2010 Burch et al.
2010/0269644 A1 10/2010 Edland et al.

FOREIGN PATENT DOCUMENTS

JP 60131715 9/1985
JP 197908 7/2004
SU 1745535 7/1992
WO 01/27479 4/2001
WO 2008136765 11/2008
WO 2009094107 7/2009
WO 2010101341 10/2010

OTHER PUBLICATIONS

International Search Report and Written Opinion for PCT/US2012/052084.
International Search Report and Written Opinion for PCT/US2011/043198.
Polar Handtools, Handtool Catalogue, catalog, 2009, p. 6, Polar Tools A/S, Denmark.

* cited by examiner

TORQUE TRANSMISSION DRIVER

CROSS-REFERENCE TO RELATED APPLICATIONS

This application is a national stage application of PCT Application No. PCT/US2011/043198, filed on Jul. 7, 2011, which claims priority to U.S. Provisional Patent Application No. 61/362,107, filed on Jul. 7, 2010, the disclosures of which are incorporated herein by reference.

BACKGROUND AND SUMMARY

The present invention is directed to an improved torque transmission driver used to transmit torque from a torque generating source, such as a power drill, to a fastener for assembly of a structure or device, most notably where the fastener is small.

Torque transmission drivers have been commonly used in assembling structures and devices with threaded fasteners such as screws and bolts. Such torque transmission drivers transmit the torque created by a torque generator to the fastener to thread a fastener into an assembly. Various such torque transmission drivers have been provided in the past, usually having the shape of a drive end complementary to a recess in or projections from the heads of fasteners, with which they are used. Examples are drill chucks and screw drivers.

To illustrate, U.S. Pat. No. 2,397,216 issued in 1946 discloses a number of forms or shapes of torque transmission drive systems. Known are the hex-type and cruciform-type torque transmission driver such as the PHILLIPS® torque drive system. Also, U.S. Pat. No. 3,584,667 shows a torque transmission driver which has been widely used in automotive, aerospace and appliance manufacture and marketed under the brand name TORX®. Various lobe-type torque drive systems similar to the TORX® drive system are also shown in U.S. Pat. Nos. 5,025,688, 4,269,246, 4,006,660, 3,885,480, 2,969,250 and 2,083,092 issued between 1991 and 1938. See also U.S. Patent Application Pub. No. US 2010/0129176 published May 27, 2010.

Despite the previous developments in torque transmission drivers, there remains a need for a torque transmission driver with the capability to more rapidly locate and marry the driver to the recess of a fastener, to provide better torque transmission capability over past torque drivers, and to reduce strip out of the recess of the fastener and reduce variation in drive torque failures. This need has been particularly acute and long recognized in torque transmission drivers for small fasteners, where the recess in the head of the fastener is less than 0.100 inch, or less than 0.060 inch, in the major dimension. These small fasteners have been generally difficult to engage and maintain stabilized with the torque transmission driver during installation, have had reduced engagement with the torque transmission driver limiting the amount of torque that could be transmitted from the driver to the fastener, and have had fine threads that could more readily be cross threaded and/or stripped out during installation with previously known torque drivers. As a result, in the past special installation tools have had to be used for these fasteners, which in turn limited the serviceability and repair ability of the structure or device assembled using the fasteners. Moreover, because of variability in installation torque, the quality control of the assembly was difficult if not impossible to maintain with previous transmission torque drivers.

A torque transmission driver is presently disclosed that comprises a drive axis and a main body having a first end portion and a second end portion, where the first end portion is adapted to receive and transmit torque from a torque generating source to the driver, and where the second end portion opposite the first end portion has a key shape and a protruding lead end, the key shape is adapted to fit a recess in a fastener and has a major dimension of less than 0.06 inches and a minor dimension, and the protruding lead end has a taper between 10° and 30° from a plane perpendicular to the drive axis of the driver and different in shape than the key shape with at least a portion of the protruding lead end initiating at the major dimension of the key shape. Alternatively, the protruding lead end of the second end portion of the main body may have a taper between 15° and 25°, or between 18° and 22°.

Additionally, the protruding lead end of the second portion of the main body is shaped to match the recess in a fastener such that torque can be transmitted from the second portion of the main body to the fastener through the protruding lead end. The protruding lead end may have a shape selected from the group consisting of a cone shape, a dome shape, a trapezoidal shape, and a polyhedral shape. The protruding lead end may be magnetized such as to facilitate contact between the protruding lead end and a fastener.

The key shape in the second end portion of the main body may have a shape selected from the group consisting of a quadrasplinular, pentasplinular, hexasplinular, quadralobular, pentalobular, hexalobular, hexagonal, and pentagonal.

Also disclosed is a torque transmission driver adapted to drive a small fastener having a recess with a major dimension less than 0.1 inches that comprises a drive axis and a main body having a first end portion and a second end portion, where the first end portion is adapted to receive and transmit torque from a torque generating source to the driver, and where the second end portion opposite the first end portion has a key shape and a protruding lead end, the key shape is adapted to fit a recess in a fastener and has a major dimension of less than 0.10 inches and a minor dimension, and the protruding lead end has a taper between 10° and 30° from a plane perpendicular to the drive axis of the driver and different in shape than the key shape with at least a portion of the protruding lead end initiating at the major dimension of the key shape. Alternatively, the key shape of the second end portion of the main body may be adapted to fit a recess having a major dimension of up to 0.060 inch or of up to 0.040 inch in the fastener.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION OF THE DRAWINGS

Referring generally to FIGS. 1 through 8, a torque transmission driver is presently disclosed that is adapted to transmit torque from a torque generating source, such as a power screw driver, to a fastener for assembly of a structure or device, most notably where the fastener is small.

Figure 1:
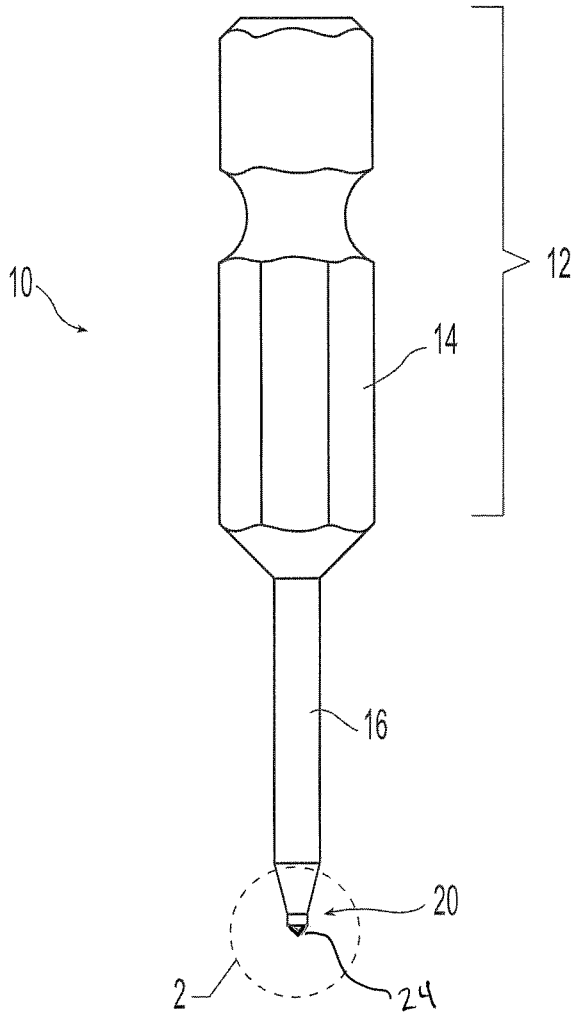
FIG. 1 is a front view of a torque transmission driver.

As shown in FIG. 1, a torque transmission driver has a main body 10 having a first end portion 12 and a second end portion 20. The torque transmission driver also has a drive axis about which the torque transmission driver rotates during operation. The first end portion of the main body is adapted to receive and transmit torque from a torque generating source (not shown). The first end portion 12 illustrated in FIG. 1 is a hexagonal shank 14 capable of being secured in the chuck of a torque generating source, such as a power drill or power screw driver. A torque transmission driver may also be manually operated where a user provides the desired torque. A wide variety of torque generating sources are known and the first end portion may be selected to accommodate one or more desired torque generating sources. For example, the first end portion may be a circular shank capable of use with a variety of configurable tools. In another alternative, the first end portion may be a handle sized to accommodate a user's hand for providing torque generation, and the main body of the torque transmission driver may form a manually operable tool. As such, the torque transmission driver presently disclosed may be adapted to transmit torque to a fastener in manual, powered, and automated applications.

The main body 10 of the torque transmission driver has a second end portion 20 opposite the first end portion 12. The main body 10 may have an extension 16 operably connecting the first end portion 12 and the second end portion 20. The extension 16 may be used to extend the reach of second end portion 20 from the first end portion 12, or to facilitate marriage to the recesses of fasteners to thread the fastener into a workpiece or assembly.

Figure 2:
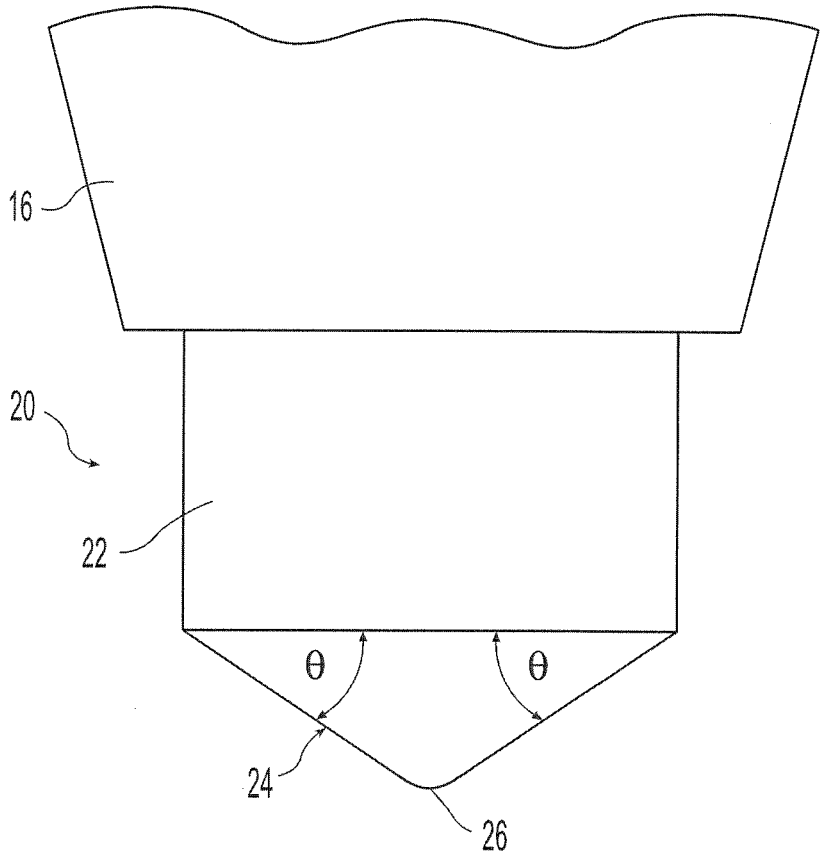
FIG. 2 is a detail view of the lead end of the torque transmission driver of FIG. 1.

Referring to FIG. 2, the second end portion 20 of a torque transmission driver is illustrated in an enlarged elevation view. The second end portion 20 of the main body has a key shape 22 adapted to fit a recess in a fastener, and has a protruding lead end 24 different in shape than the key shape and having a taper adapted to match at least a portion of the recess in a fastener. As shown, the second end portion 20 may be connected to the extension 16 or other support structure of the main body of the torque transmission fastener. As shown in FIG. 2, at least a portion of the protruding lead end 24 initiates at the major dimension of the key shape. The taper may extend to the major dimension of the key shape for at least a portion of the protruding lead end, such as the portion of the protruding lead end aligned with the lobes of the key shape of the second end portion. In one embodiment, the protruding lead end initiates at the major dimension of the key shape and tapers to match at least a portion of the recess in a fastener.

The key shape 22 of the second end portion 20 is configured to transfer a torque force to the bearing surfaces of a socket recess in a fastener. As described below with reference to FIGS. 6 and 7, second end portion 20 in the main body may be formed in a variety of key shapes to marry with socket recesses in fasteners to transmit torque in accordance with the present torque transmission driver. The surfaces of the key shape 22 may be designed to be parallel to the longitudinal axis of the torque transmission driver. As the torque transmission driver is rotated about the drive axis, the key portion 22 engages the walls or axial bearing surfaces of the socket recess in the fastener to transfer torque to the fastener.

The torque transmission driver may be particularly adapted to drive a small fastener, where the second end portion 20 has a key shape 22 adapted to fit a recess having a major dimension of up to about 0.100 inch in a fastener. For example, the key shape 22 may be the size of a T3 TORX® brand bit adapted to fit a corresponding fastener recess. Alternatively, the key shape 22 may have the size of a T1 TORX® brand bit, or smaller, adapted to fit a corresponding fastener recess. Alternatively, the second end portion may have a key shape adapted to fit smaller or larger recesses, such as recesses in a fastener having a major dimension of up to about 0.040 inch, or up to about 0.060 inch in a major dimension. In each instance, the configuration of the key shape is such as to fit the recess of the fastener and transmit torque from the torque transmission driver to the fastener for installing or removing the fastener in a device, structure or other assembly.

In any case, the second end portion 20 of the main body has protruding lead end 24. The protruding lead end 24 has a taper, illustrated by angle θ, adapted to match at least a portion of the recess in the fastener. Alternatively, the protruding lead end 24 may have a taper adapted to match a majority of the recess in the fastener. The protruding lead end 24 may be shaped to complement the recess in a fastener such that torque can be transmitted from the second portion of the main body to the fastener through the protruding lead end. The protruding lead end 24 extends from the key shape 22 of the second end portion 20. As such, the protruding lead end 24 may generally be illustrated as the end portion of the torque transmission driver. The protruding lead end 24 may have a tip 26. The tip 26 may be pointed or rounded. A rounding of the tip 26 may be desirable to reduce scratching or other undesired abrasions when the torque transmission driver is entering the recess in the fastener when in use and to extend the useful life of the driver.

Figure 4:
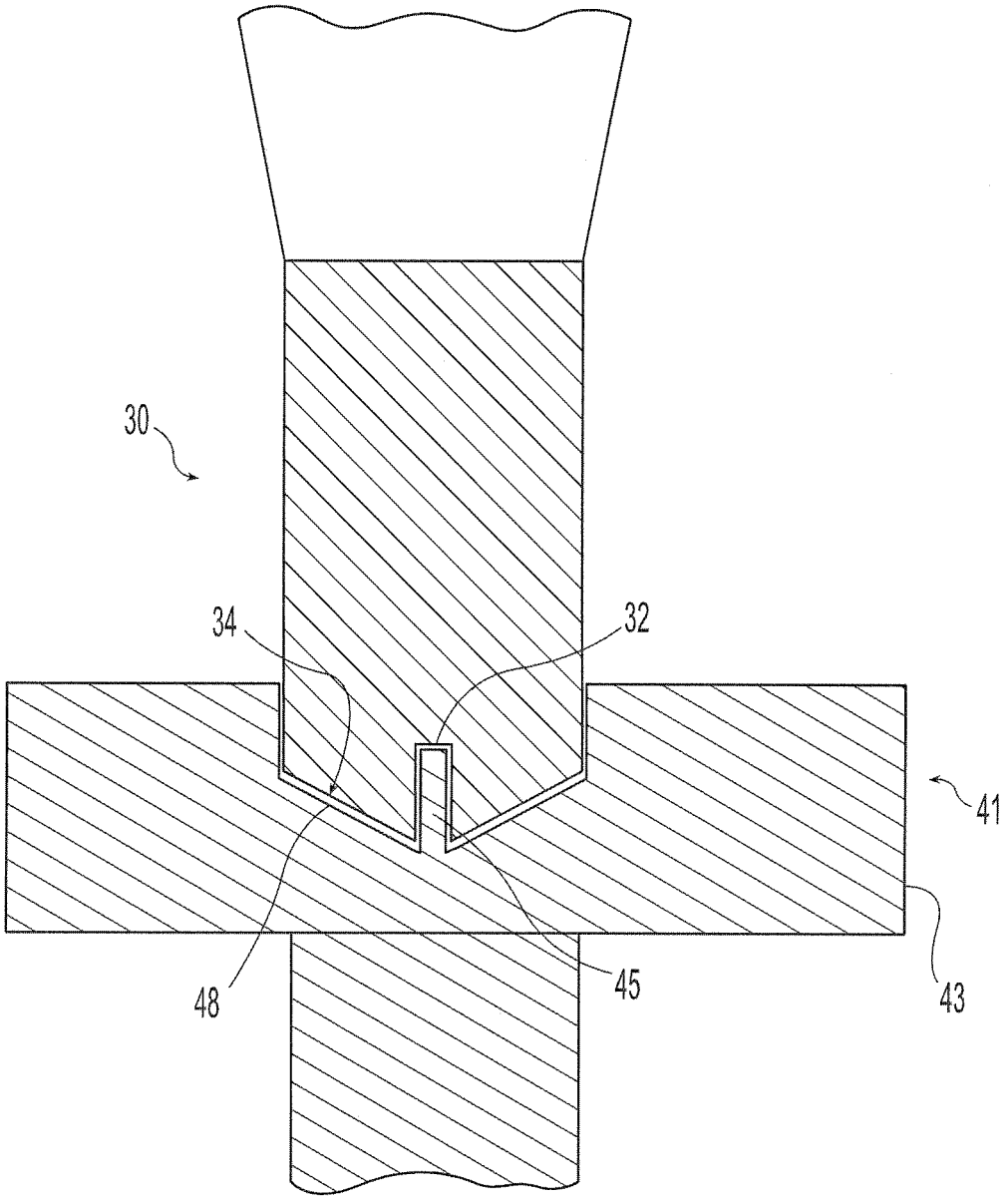
FIG. 4 is a cross-section view of another torque transmission driver engaging a fastener.

The protruding lead end 24 may have a generally conical shape extending from the key shape 22. As illustrated in FIG. 2, the protruding lead end 24 has a generally cone shape with a rounded tip 26. Other configurations of the protruding lead end 24 are also possible with the present disclosure. By way of illustration, a variety of configurations for the protruding lead end are illustrated in FIGS. 8A-8E. The protruding lead end may have a pointed cone shape 81 or a rounded cone shape 82. The protruding lead end may have a trapezoidal cross section 83 or may have a dome shape 84. As will be apparent, the taper of the protruding lead end extends generally from the key shape portion through at least a portion of the protruding lead end; however, the taper need not extend throughout the entire length of the protruding lead end such as in the trapezoidal or dome configurations illustrated. Additionally, the protruding lead end may be provided with an anti-tamper aperture such as illustrated in FIG. 4. Both the cross-section and length of the protruding lead end may be varied to provide the desired configuration.

Figure 8A:
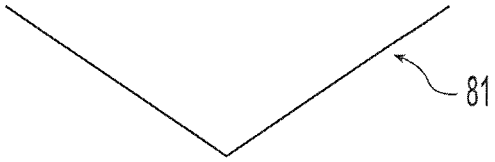
FIGS. 8A-8E are views of protruding lead ends.
Figure 8B:
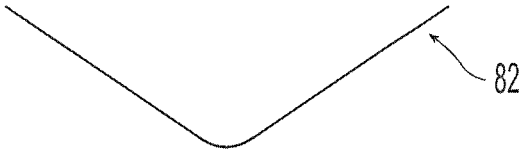
Figure 8C:
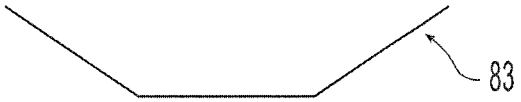
Figure 8D:
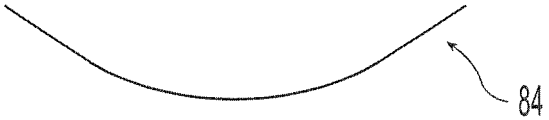
Figure 8E:
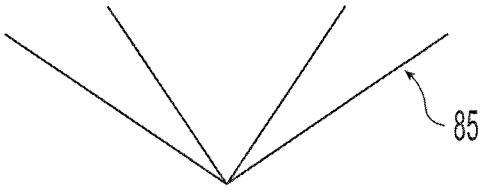

In some alternatives, the protruding lead end may have a generally polyhedral configuration. As illustrated in FIG. 8E, the protruding lead end may comprise a tapering hexagonal configuration 85 for at least a portion of the protruding lead end. In this example, the protruding lead end may conform to a tapering of the key shape of the second end portion of the main body. Alternatively, the protruding lead end may have a tapering cross-section different than the key shape of the second end portion. As indicated, the protruding lead end 24 may have a variety of configurations with a taper adapted to complement at least a portion of a recess in a fastener.

Figure 3:
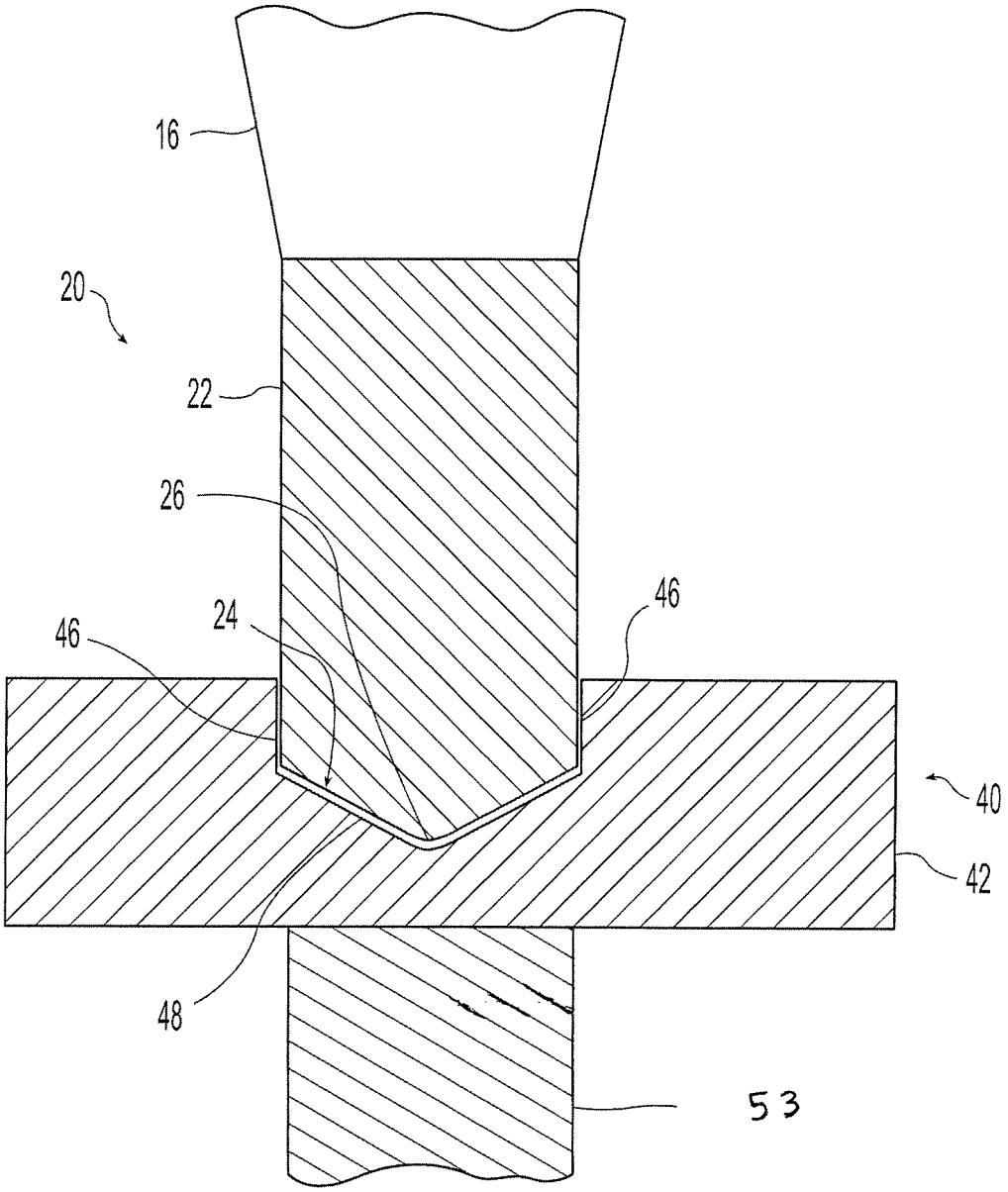
FIG. 3 is a cross-section view of a torque transmission driver engaging a fastener.

During use, the torque transmission driver is inserted into the recess in a fastener, as shown in FIG. 3. A fastener 40 has a head 42 having a recess and a shaft 53 having threads (not shown). The second portion 20 of the torque transmission driver may be inserted into the recess of the fastener head 42, such that when the torque transmission driver is rotated about the drive axis, torque may be transferred to the fastener 40. The key shape 22 of the second portion 20 operably engages the axial bearing surfaces 46 of the head and facilitates threading of the fastener into an assembly. The protruding lead end 24 of the second portion 20 extends from the key shape 22 and may complement at least a portion of the recess, such as the lower portion 48 of the recess in the head 42 of the fastener 40. As illustrated in FIG. 3, the taper of the protruding lead end 24 may be substantially similar to the taper or slope of the lower portion 48 of the recess.

During marriage to a fastener, the taper of the protruding lead end 24 may promote alignment of the torque transmission driver to the recess of the fastener head 42. If the torque transmission driver is inserted off center from the fastener recess, the taper of the protruding lead end 24 promotes centering or alignment of the torque transmission driver with the recess in the head of the fastener. This centering process may reduce mating time and improve the productivity of the torque transmission driver.

In addition, the protruding lead end 24 of the second end portion 20 of the torque transmission driver contacts at least a portion of the lower portion 48 of the recess in the head 42 of the fastener 40 to assist in transmission of torque from the driver to the fastener. The recess or socket of many fasteners, and particularly small fasteners having a major dimension of less than 0.050 inch or less than 0.030 inch, may be formed by punching or stamping the head with a tool to create the desired socket configuration and form the axial bearing surfaces of the recess. Such tools are generally tipped to facilitate the punching or stamping operation and result in a cavity extending below the axial bearing surfaces, such as the lower portion 48 of the recess illustrated in FIG. 3. The protruding lead end 24 of the second end portion 20 of the torque transmission driver may therefore approximate the taper of the tool used to form the socket recess in the head 42 of the fastener 40 to assist the transmission of torque from the driver to the fastener.

The angle θ of the taper, as illustrated in FIG. 2, of the protruding lead end 24 of the second portion 20 may be selected within a desired range. For example, the angle θ of the taper may be between 10° and 30°. Alternatively, the angle θ of the taper may be between, 15° and 25°, or between 18° and 22°. In one example, the angle θ of the taper may be approximately 20° to substantially conform to the lower portion 48 of the recess in the head 42 of a fastener 40. In any case, the protruding lead end 24 contacts at least a portion of the lower portion 48 of the fastener head 42.

During use when the torque transmission driver is rotated about the drive axis, torque is partially transmitted from the second portion 20 of the main body to the fastener 40 through the protruding lead end 24. The protruding lead end 24 frictionally engages at least a portion of the lower portion 48 of the recess in the fastener head 42 to assist in the transmission of torque to the fastener, supplementing the torque transmitted through the key shape 22 of the second end portion 20 to provide greater and more efficient torque transmission from the driver to the fastener 40. In some examples, the protruding lead end 24 may frictionally engage a majority of the lower portion 48 of the recess in the fastener head 42. Increasing the total surface area over which torque is applied may also reduce wear on the torque transmission driver, reduce wear on the fastener 40, or both, and reduce the potential for cross threading and strip out of the fastener. The application of greater total torque to the fastener may also be possible with the torque transmission driver presently disclosed by increasing engagement between the torque transmission driver and the fastener. The protruding lead end 24 may be configured to increase engagement of the protruding lead end 24 to the lower portion 48 of the recess in the fastener head, such as by adapting the protruding lead end to increase desired points of contact with the recess in the fastener head.

The protruding lead end may also be magnetized to facilitate contact and marriage between the protruding lead end and a fastener. A magnetized protruding lead end allows a fastener to more rapidly contact and maintain connection between the protruding lead end of the driver and the head of the fastener during threading of a fastener in an assembly.

Referring to FIG. 4, another torque transmission driver is illustrated adapted for use with a tamper resistant fastener 41. In one example, a tamper resistant fastener 41 may have a fastener head 43 having an anti-tamper feature, such as pin 45. The torque transmission device may have a second end portion 30 having an aperture 32 adapted to receive pin 45 such that the torque transmission driver may be inserted into the recess of fastener 41 and operably engage the fastener. The aperture 32 of the torque transmission driver may be positioned in the protruding lead end 34 of the second end portion 30 of the main body and may extend as needed into the second end portion 30 to accommodate pin 45. As shown, pin 45 in the recess of the fastener 41 would interfere with the insertion of a torque transmission driver that does not include corresponding aperture 32. The length and cross-section of the pin 45 and aperture 32 may be selected as desired to establish the relationship between the fastener and the torque transmission driver.

Figure 5:
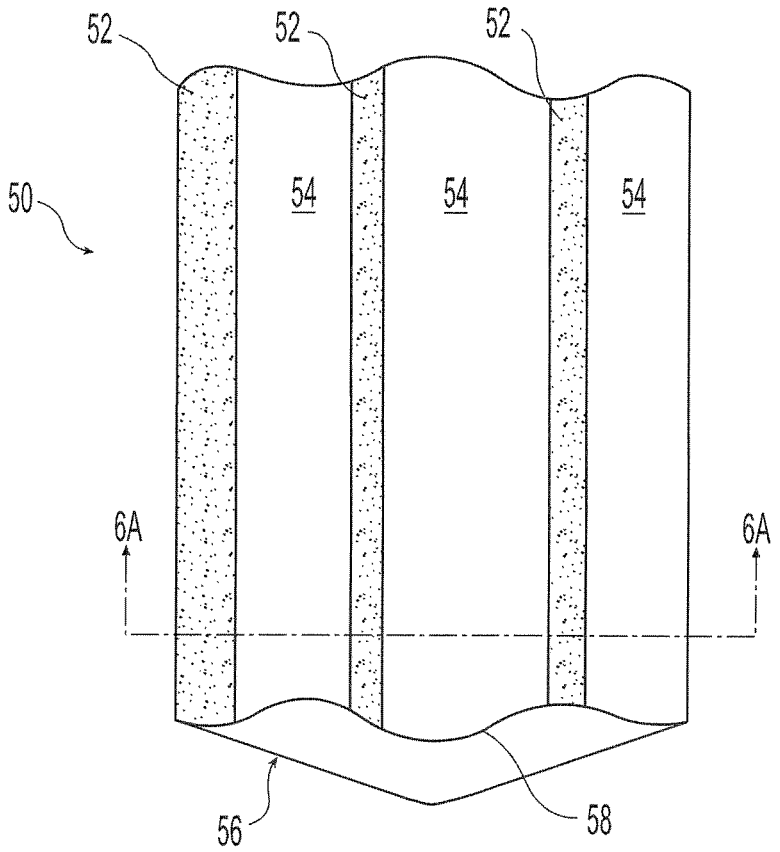
FIG. 5 is a perspective view of a lead end of a torque transmission driver.
Figure 6A:
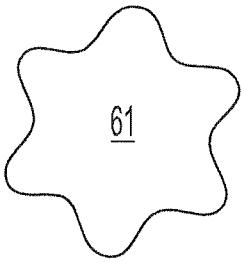
FIGS. 6A-6G are cross-section views of keys for use with a torque transmission driver.

The torque transmission driver presently disclosed may be configured for a variety of key shapes. As illustrated in FIGS. 5 and 6A, the second end portion 50 of a main body of a torque transmission driver may have a hexalobular key shape as indicated by the protrusions or lobes 52 alternating with the spaces or antilobes 54. The protruding lead end 56 may extend from the key shape of the second portion 50. A transition 58 between the key shape of the second end portion 50 and the protruding lead end 56 of the second end portion may be configured as desired to transition from the key shape to the taper of the protruding lead end. The taper of at least a portion of the protruding lead 56 end may initiate at the major dimension of the key shape between opposing lobes 52.

Referring generally to FIGS. 6B-6G, a plurality of alternative key shapes are illustrated for use with the torque transmission driver. As will be apparent, the key shape of the torque transmission driver is selected to match the socket recess of the desired fastener. Similarly, the key size is selected to match the socket size of the desired fastener. As such, a set of torque transmission drivers may be created comprising a plurality of key shapes and sizes to accommodate a range of desired fasteners.

Figure 6B:
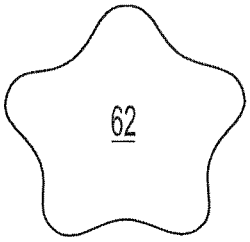
Figure 6C:
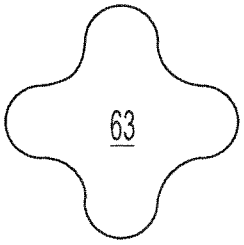

Referring to FIGS. 6A-6C, the key shape of the second end portion of the main body of the torque transmission driver may have a poly-lobular configuration. The polylobular configuration may be hexalobular 61, pentalobular 62, or quadralobular 63 as illustrated in FIGS. 6A-6C respectively. The lobes may be substantially symmetric as illustrated; however, other poly-lobular configurations are presently available and may be used with the torque transmission driver. The hexalobular 61 and pentalobular 62 keys are currently offered under the TORX® brand. Alternatively, the polylobular key shape may be referred to as a star key or star driver.

Figure 6D:
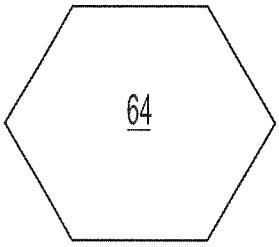
Figure 6E:
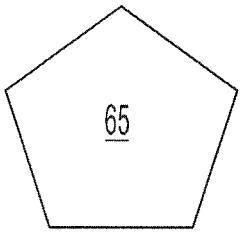

Referring to FIGS. 6D-6E, the key shape of the second end portion of the main body of the torque transmission driver may have a poly-sided configuration, such as a substantially polygonal configuration. The polygonal configuration may be a hexagonal key 64 as shown in FIG. 6D. The hexagonal key 64 may also be known as a hex key or Allen key. Other polygonal shapes such as pentagonal 65 may be used as illustrated in FIG. 6E. A poly-sided configuration may have substantially straight side portions. The corners of a poly-sided key may be angular or may be rounded as desired. In some instances, a rounding of the corners may be desired to facilitate insertion of the second end portion of the main body into a socket recess in a fastener and inhibit scratching of a fastener, work piece, or user.

Figure 6F:
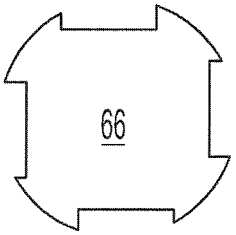
Figure 6G:
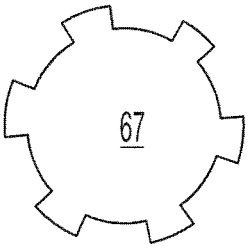

As shown in FIGS. 6F-6G, two exemplary poly-splinular shapes of the key are illustrated, including quadrasplinular 66 and hexasplinular 67 configurations. Other shapes may also be selected such as a five spline, or pentasplinular design, and designs comprising other numbers of splines. The poly-splinular shapes may also be known as Bristol keys or drives. As will be apparent, the number and shape of splines may be selected to match the socket recess or recesses of the fastener chosen for a given application.

Other key shapes of the second end portion of the main body may be used with the torque transmission driver presently disclosed. Additional key shapes that may be used include, but are not limited to, triangle, double hex, triple square, polydrive, triangular recess (TP3), and tri-wing. Proprietary or custom key shapes may also be selected for use with matching fastener socket recesses. As will be apparent the key shape may be selected to provide a desired application of torque to the fastener and at the same time inhibit strip out of the fastener during installation. Additionally, each key design may also be provided in a tamper resistant variety, such as previously discussed.

Figure 7A:
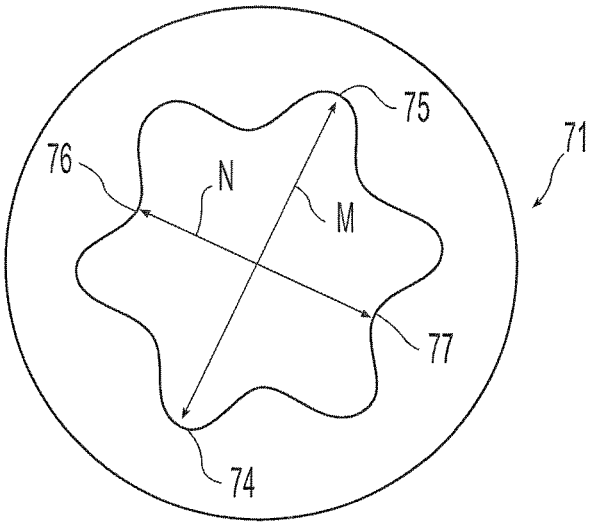
FIGS. 7A-C are top views of fasteners.
Figure 7B:
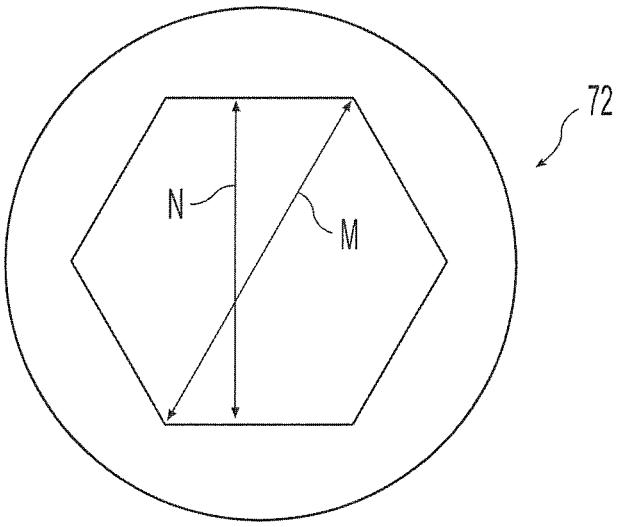
Figure 7C:
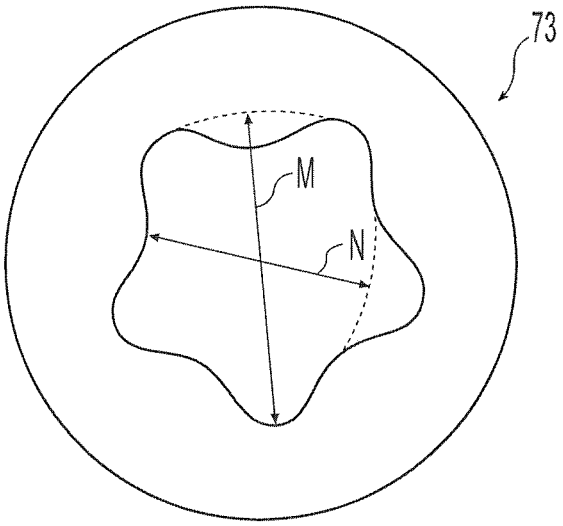

By way of illustration, a selection of fastener recesses are illustrated in FIGS. 7A-7C. The fastener socket recess shown in FIG. 7A is a hexalobular socket 71 appropriate for use with the hexalobular key 61 of FIG. 6A. Alternatively, the fastener socket recess shown in FIG. 7B is a hexagonal shape 72 appropriate for use with the hexagonal key 64 or Allen key of FIG. 6D. The fastener socket recess shown in FIG. 7C is a pentalobular socket 73 appropriate for use with the pentalobular key 62 shown in FIG. 6B. As will be apparent, each key shape fits one or more socket recesses in desired fasteners.

In any case, the fastener socket recess has a major dimension M and a minor dimension N as shown in FIG. 7A. The major dimension M is the dimension of the socket extending between opposing lobes 74, 75 on the hexalobular socket illustrated. The minor dimension N is the dimension of the socket extending between opposing spaces or anti-lobes 76, 77 between the lobes.

More generally, the major dimension of a fastener may be defined as the diameter of a circle centered on the longitudinal axis of the fastener and having a radius extending from the longitudinal axis to a point on the perimeter of the socket recess furthest from the longitudinal axis of the fastener. The minor dimension may be defined as the diameter of a circle centered on the longitudinal axis of the fastener and having a radius extending from the longitudinal axis to a point on the perimeter of the socket closest to the longitudinal axis of the fastener. By way of illustration, the hexagonal socket recess 72 has a major dimension M and a minor dimension N as shown in FIG. 7B. A pentalobular socket 73 has a major dimension M and a minor dimension N as shown in FIG. 7C.

The torque transmission driver may be made in a variety of ways. The first end of the main body may be produced by conventional methods for producing shanks or handles of torque transmission drivers. In one example, the second end portion of the torque transmission driver may be machined from a blank stock. Alternatively, a protruding lead end 24 may be formed on the end of an existing key shape portion, such as by machining the end of the key shape portion to provide the desired taper.

The torque transmission driver presently disclosed may permit faster installation by improving the ability of the driver to seat in a fastener recess, and therefore reduce the driver to recess marriage time and maintain the connection. The present torque transmission driver may also provide improved torturing capability over standard drivers, reduce strip out of fastener recesses, and reduce variation of driver torque to failure providing more consistent and reliable insertion of fasteners into work pieces or assemblies. The torque transmission driver may also provide improved tool life over prior drivers.

To illustrate the benefits of the present torque transmission driver, a driver torque to failure test was performed using a torque transmission driver of the present disclosure, and compared with the drive torque to failure of three prior driver designs. The results are shown in Table 1 below.

TABLE 1

| Sample # | Cross | Torx | Flat | Cone |
|---|---|---|---|---|
| 1 | 1.157* | 1.597** | 1.973+ | 1.774+ |
| 2 | 0.962* | 1.590** | 2.046* | 1.661+ |
| 3 | 1.044* | 1.588** | 1.956+ | 1.719+ |
| 4 | 1.290* | 1.573** | 1.840+ | 1.661+ |
| 5 | 1.011* | 1.925** | 1.630+ | 1.701+ |
| 6 | 0.916* | 1.597** | 1.845+ | 1.644+ |
| 7 | 1.082* | 1.635** | 1.743+ | 1.748+ |
| 8 | 0.933* | 1.785** | 1.763+ | 1.719** |
| 9 | 1.119* | 1.661** | 1.825+ | 1.752+ |
| 10 | 1.077* | 1.734** | 1.714+ | |
| Samples | 10 | 10 | 10 | 9 |
| MEAN | 1.059 | 1.669 | 1.834 | 1.709 |
| STD DEV | 0.113 | 0.114 | 0.129 | 0.046 |
| X +3STD | 1.399 | 2.01 | 2.219 | 1.846 |
| X −3STD | 0.719 | 1.327 | 1.448 | 1.572 |
| Maximum | 1.29 | 1.925 | 2.046 | 1.774 |
| Minimum | 0.916 | 1.573 | 1.63 | 1.644 |

*Recess Failure
**Bit Failure
+Thread Failure

Referring to Table 1, three prior driver designs were tested, including "Cross" (JCIS or PHILLIPS® screwdriver), "Torx" (conventional TORX® driver), and "Flat". The "Flat" was a design having a flat end without a protruding lead end 24. The "Cone" represents a torque transmission driver of the present invention where the protruding lead end 24 comprises a cone configuration as previously discussed. As seen in Table 1, each test of the Cross driver resulted in failure of the fastener recess. Each test of the TORX® driver resulted in failure of the driver bit. The standard deviation of the drive torque to failure of the presently disclosed driver was approximately 60% improved as compared to the prior art drivers.

While certain embodiments have been described, it must be understood that various changes may be made and equivalents may be substituted without departing from the spirit or scope of the present disclosure. In addition, many modifications may be made to adapt a particular situation or material to the teachings of the disclosure without departing from its spirit or scope.

What is claimed is:

1. A torque transmission driver adapted to fit a recess in a fastener of less than 0.06 inches major dimension comprising:

a torque transmission driver having a drive axis and a main body with a first end portion and a second end portion, the first end portion adapted to receive and transmit torque from a torque generating source to the driver; and the second end portion opposite the first end portion having a key shape and a protruding lead end, the key shape adapted to fit a recess in a fastener and having a major dimension of less than 0.06 inches and a minor dimension, the protruding lead end having a taper between 10° and 30° from a plane perpendicular to the drive axis of the driver and different in shape than the key shape with at least a portion of the protruding lead end initiating at the major dimension of the key shape.

2. The torque transmission driver as set forth in claim 1 wherein the protruding lead end of the second portion of the main body is shaped to match the recess in a fastener such that torque can be transmitted from the second portion of the main body to the fastener through the protruding lead end.

3. The torque transmission driver as set forth in claim 1 wherein the protruding lead end of the second end portion of the main body has a taper angle between 15° and 25°.

4. The torque transmission driver as set forth in claim 3 where the protruding lead end of the second end portion of the main body has a taper between 18° and 22°.

5. The torque transmission driver as set forth in claim 1 wherein the protruding lead end of the second end portion of the main body is magnetized.

6. The torque transmission driver as set forth in claim 1 wherein the key shape in the second end portion of the main body has a shape selected from the group consisting of a quadrasplinular, pentasplinular, hexasplinular, quadralobular, pentalobular, hexalobular, hexagonal, pentagonal, Bristol and polydrive.

7. The torque transmission driver as set forth in claim 1 wherein the protruding lead end has a taper adapted to match a portion of the recess in the fastener.

8. A torque transmission driver adapted to drive a small fastener having a recess with a major dimension less than 0.1 inches comprising:

a torque transmission driver having a drive axis and a main body with a first end portion and a second end portion, the first end portion adapted to receive and transmit torque from a torque generating source to the driver; and the second end portion opposite the first end portion having a key shape and a protruding lead end, the key shape adapted to fit a recess in a fastener and having a major dimension of less than 0.1 inches and a minor dimension, the protruding lead end having a taper between 10° and 30° from a plane perpendicular to the drive axis of the driver and different in shape than the key shape with at least a portion of the protruding lead end initiating at the major dimension of the key shape.

9. The torque transmission driver adapted to drive a small fastener as set forth in claim 8 wherein the protruding lead end of the second portion of the main body is shaped to match the recess in a fastener such that torque can be transmitted from the second portion of the main body to the fastener through the protruding lead end.

10. The torque transmission driver adapted to drive a small fastener as set forth in claim 8 wherein the protruding lead end of the second end portion of the main body has a taper angle between 15° and 25°.

11. The torque transmission driver adapted to drive a small fastener as set forth in claim 10 where the protruding lead end of the second end portion of the main body has a taper between 18° and 22°.

12. The torque transmission driver adapted to drive a small fastener as set forth in claim 8 wherein the protruding lead end of the second end portion of the main body is magnetized.

13. The torque transmission driver adapted to drive a small fastener as set forth in claim 8 wherein the key shape in the second end portion of the main body has a shaped selected from the group consisting of quadrasplinular, pentasplinular, hexasplinular, quadralobular, pentalobular, hexalobular, hexagonal, pentagonal, Bristol and polydrive.

14. The torque transmission driver adapted to drive a small fastener as set forth in claim 8 wherein the key shape of the second end portion of the main body is adapted to fit a recess having a major dimension of up to 0.060 inch in the fastener.

15. The torque transmission driver adapted to drive a small fastener as set forth in claim 8 wherein the key shape of the second end portion of the main body is adapted to fit a recess having a major dimension of up to 0.040 inch in the fastener.

16. The torque transmission driver as set forth in claim 8 wherein the protruding lead end has a taper adapted to match a portion of the recess in the fastener.

* * * * *